US006289934B1

(12) United States Patent
Welker

(10) Patent No.: US 6,289,934 B1
(45) Date of Patent: Sep. 18, 2001

(54) FLOW DIFFUSER

(75) Inventor: Robert H. Welker, Washington, TX (US)

(73) Assignee: Welker Engineering Company, Sugar Land, TX (US)

( * ) Notice: Subject to any disclaimer, the term of this patent is extended or adjusted under 35 U.S.C. 154(b) by 0 days.

(21) Appl. No.: 09/360,424

(22) Filed: Jul. 23, 1999

(51) Int. Cl.[7] ..... F15D 1/00

(52) U.S. Cl. ..... 138/39; 138/37; 138/43; 138/46; 251/118; 137/625.28

(58) Field of Search ..... 138/37, 39, 42, 138/43, 46; 251/118, 126, 127; 137/625.28, 625.3, 625.38

(56) References Cited

U.S. PATENT DOCUMENTS

| | | | |
|---|---|---|---|
| Re. 32,197 | 7/1986 | Self . | |
| 1,539,435 | 5/1925 | Schurtz . | |
| 1,570,907 | 1/1926 | McKee | 251/127 |

(List continued on next page.)

FOREIGN PATENT DOCUMENTS

| | | |
|---|---|---|
| 2810118 | 9/1979 | (DE) . |
| 0 097 312 | 1/1984 | (FR) . |
| 59140973 | 8/1984 | (JP) . |

OTHER PUBLICATIONS

Pipe Line & Gas Industry magazine; "New gas–pressure regulator blends features of boots, plugs", May 1999; pp. 59–71.

Fisher–Rosemount; "Type EZR Pressure Reducing Regulator," Bulletin 71.2:EZR; Jan. 1999; pp. 1–24.

Fisher Controls; "Cavitrol V Trim," Bulletin 80.2:020; May 1979; pp. 1–4.

Fisher–Rosemount; "CAvitrol III–Stage Trim," Bulletin 80.1:010; 1997; pp. 1–6.

American Meter Company; "Radkal Flow Valves"; Aug. 1997; pp. 1–16.

Mooney Controls; "2–Flanged Single Port Flowgrid Valve"; 1991; pp. 1–6.

Fisher–Rosemount; "WhisperFlo Trim" 1997; pp. 1–10.

Fisher–Rosemount; "WhisperFlor Aerodynamic Attenuation Trims," Bulletin 80.3:010; Feb. 1999; pp. 1–4.

Fisher–Rosemount; "WHisper Trim 1 Cage," Bulletin 80.1:006; 1997; p. 1.

Fisher–Rosemount; "Whisper Trim III Cages," Bulletin 80.1:010; 1997; pp. 1–4.

Fisher Controls; "High Performance Control"; 1989; pp. 1–12.

Fisher–Rosemount; "Type 399A Pilot–Operated Pressure–Reducing Regulator; " Bulletin 71.2:399A–161; 1996; pp. 1–24.

* cited by examiner

*Primary Examiner*—James Hook
(74) *Attorney, Agent, or Firm*—Blackwell Sanders Peper Martin

(57) ABSTRACT

When a fluid passes through a conventional elbow or valve in a piping system, turbulence is created in the fluid flow. The fluid may not stabilize and return to a laminar flow until 40–50 pipe diameters downstream. Turbulence in a piping system can cause a variety of problems such as noise, vibration, and/or erosion. Turbulence also creates a pressure drop which is undesirable. The flow diffuser of the present invention may be configured as a 90° elbow for use in a piping system to reduce turbulence and pressure drops as the fluid passes through the improved elbow. The elbow of the present invention included an elongate tapered discharge nozzle. The elbow can restore substantially laminar flow in a space of about four pipe diameters.

18 Claims, 9 Drawing Sheets

U.S. PATENT DOCUMENTS

| | | | | |
|---|---|---|---|---|
| 2,198,730 | | 4/1940 | Kadenacy | 138/37 |
| 2,359,579 | * | 10/1944 | Peck | 138/39 |
| 2,884,956 | * | 5/1959 | Perlin | 138/39 |
| 3,157,200 | | 11/1964 | Rowan | 137/625.33 |
| 3,170,483 | | 2/1965 | Milroy . | |
| 3,207,484 | | 9/1965 | Rubin . | |
| 3,271,845 | | 9/1966 | Breher . | |
| 3,381,713 | * | 5/1968 | Jacobsen | 138/39 |
| 3,451,404 | | 6/1969 | Self . | |
| 3,602,261 | | 8/1971 | Brown et al. . | |
| 3,602,262 | | 8/1971 | Henden | 138/37 |
| 3,630,229 | | 12/1971 | Nagel et al. . | |
| 3,709,245 | * | 1/1973 | O'Connor, Jr. | 251/127 |
| 3,746,049 | * | 7/1973 | O'Connor, Jr. | 138/39 |
| 3,776,278 | | 12/1973 | Allen . | |
| 3,917,222 | | 11/1975 | Kay et al. . | |
| 3,920,044 | | 11/1975 | Gruner | 251/127 |
| 3,990,475 | | 11/1976 | Myers . | |
| 4,022,423 | | 5/1977 | O'Connor, et al. . | |
| 4,068,683 | | 1/1978 | Self . | |
| 4,085,774 | | 4/1978 | Baumann . | |
| 4,279,274 | | 7/1981 | Seger . | |
| 4,473,210 | | 9/1984 | Brighton | 251/127 |
| 4,534,388 | * | 8/1985 | Pall et al. | 138/37 |
| 4,614,440 | | 9/1986 | King . | |
| 4,617,963 | * | 10/1986 | Stares | 138/42 |
| 4,758,098 | | 7/1988 | Meyer . | |
| 4,929,088 | | 5/1990 | Smith . | |
| 5,014,746 | | 5/1991 | Heymann . | |
| 5,054,521 | * | 10/1991 | Hendrick | 251/208 |
| 5,063,954 | * | 11/1991 | Hendrick | 251/208 |
| 5,070,909 | | 12/1991 | Davenport . | |
| 5,074,333 | | 12/1991 | Martin . | |
| 5,307,830 | | 5/1994 | Welker . | |
| 5,454,640 | | 10/1995 | Welker . | |
| 5,730,416 | | 3/1998 | Welker . | |
| 5,769,388 | | 6/1998 | Welker | 251/118 |

FLOW DIFFUSER

BACKGROUND OF THE INVENTION

1. Field of the Invention

The present invention relates a flow diffuser with an elongate discharge nozzle which can be used as a 90° elbow in piping systems. In an alternative embodiment, the flow diffuser can be used in conjunction with a fire hydrant. The present flow diffuser facilitates better measurement because it promotes laminar flow.

2. Description of the Prior Art

In piping systems, orderly or streamlined flow is desirable. When a fluid passes through a conventional valve or a 90° turn at a conventional elbow, the fluid flow becomes disorderly or turbulent. This turbulent fluid does not return to a streamlined or laminar flow for at least 40–50 pipe diameters downstream of an elbow. (Assuming that the downstream piping is axially aligned with the outlet of the valve or elbow and has the same inside diameter.)

Turbulence can be caused by a number of factors including, but not limited to, boundary layer separation, sometimes referred to as flow separation, vortices, pressure waves, and/or cavitation. Turbulence in pipe systems often causes noise, vibration, erosion and/or stress cracking. Reduction of turbulence is desirable in valves, at elbows, in piping systems generally, upstream of gas or liquid measurement and downstream of compressor stations.

Turbulence also causes a drop in fluid pressure. Each time a fluid flows through a valve or an elbow, there is an incremental drop in fluid pressure between the inlet and the outlet. In transmission pipelines, pressure drops are undesirable. If the fluid pressure drops low enough, additional pumping stations may be required. In any event, adding pressure to the fluid in the pipeline increases transportation costs. Because the elbow of the present invention reduces turbulence, it has less of a pressure drop when compared with conventional 90° elbows.

Elbow induced turbulence has been recognized and addressed by a number of prior art designs including the vanes of U.S. Pat. No. 5,197,509 and U.S. Pat. No. 5,323,661 which are located upstream from an elbow. These vanes impart rotation to the fluid as it passes through the elbow to reduce downstream turbulence. Others have considered the deleterious effects of elbow induced turbulence and have included rotation vanes both upstream and downstream of an elbow as described in U.S. Pat. No. 5,529,084. These inventions seek to create non-turbulent or laminar flow after fluid passes through a conventional elbow.

The use of curved vanes to influence fluid flow for various reasons is not a new concept. In U.S. Pat. No. 1,570,907, a plurality of vanes were used in a locomotive to separate water from steam.

In some piping systems, granular or particulate material will quickly wear out a conventional elbow. One way to address this problem is by increasing the radius of curvature of the elbow to about 10 pipe diameters. However, this is not entirely an acceptable solution, especially in areas where space is at a premium. There have been many attempts to solve this erosion problem, including the use of inserts in the elbow, the insert being a disposable item intended to be replaced when it wears out. Examples of this type of replaceable insert in an elbow can be found in the following U.S. Pat. Nos. 1,357,259; 2,911,235; 3,942,684; and 5,590,916.

Other proposed solutions to this erosion problem include a circular pocket off the elbow. This pocket accumulates a certain quantity of the particulate material which serves as a pad to absorb the blow of the subsequent material to reduce the erosive effects thereof as shown in U.S. Pat. Nos. 4,387,914 and 5,060,984.

Conventional valves are also known to create turbulence and a pressure drop between the inlet and the outlet. Robert H. Welker, the inventor herein and the inventor of U.S. Pat. No. 5,730,416, has developed various approaches to deal with valve induced turbulence. In another patent, U.S. Pat. No. 5,769,388, Mr. Welker has developed a plurality of vanes and passageways in the valve to reduce turbulence. The apparatus shown in U.S. Pat. No. 5,769,388 has certain shortcomings because of the short discharge nozzle which tapered at an included angle of approximately 12°. There is still a need to reduce turbulence in elbows, in valves and in piping systems in general.

BRIEF SUMMARY OF THE INVENTION

The present invention can be used as a 90° elbow in piping systems to reduce turbulence and promote laminar flow. It can also be used in conjunction with a fire hydrant. The elbow is connected to an inlet conduit and an outlet conduit. The elbow includes three primary components: a flow conditioner, a transition zone, and an elongate tapered discharge nozzle. The discharge nozzle should have a taper with an included angle of about 5°–7.5° measured from the circular outlet of the tapered discharge nozzle. If the discharge nozzle tapers at a 7° included angle, it will have a length of about four times the diameter of the inlet conduit.

The flow conditioner includes a plurality of vanes defining a plurality of passageways to guide the fluid flow from the inlet into the transition zone. The purpose of the guide vanes is to reduce turbulence and promote a streamlined and/or laminar flow as the fluid turns a 90° corner. The flow conditioner can be fabricated as a replaceable part to facilitate maintenance of the elbow. In an alternative embodiment, the individual vanes can be replaceable to facilitate maintenance and prolong the life of the valve. The transition zone includes a curved outer wall extending from the side wall of the flow conditioner, the transition zone being in fluid communication with the tapered discharge nozzle.

The elbow can be used in piping systems with liquids, gases, and steam, as well as two-phase flow, three-phase flow, and dry particulate and granules.

BRIEF DESCRIPTION OF THE DRAWINGS

So that the manner in which the above-identified features and advantages of the present invention are attained and can be understood in detail, a more particular description of the invention, briefly summarized above, may be had by reference to the embodiment thereof which is illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DETAILED DESCRIPTION OF THE INVENTION

Figure 1:
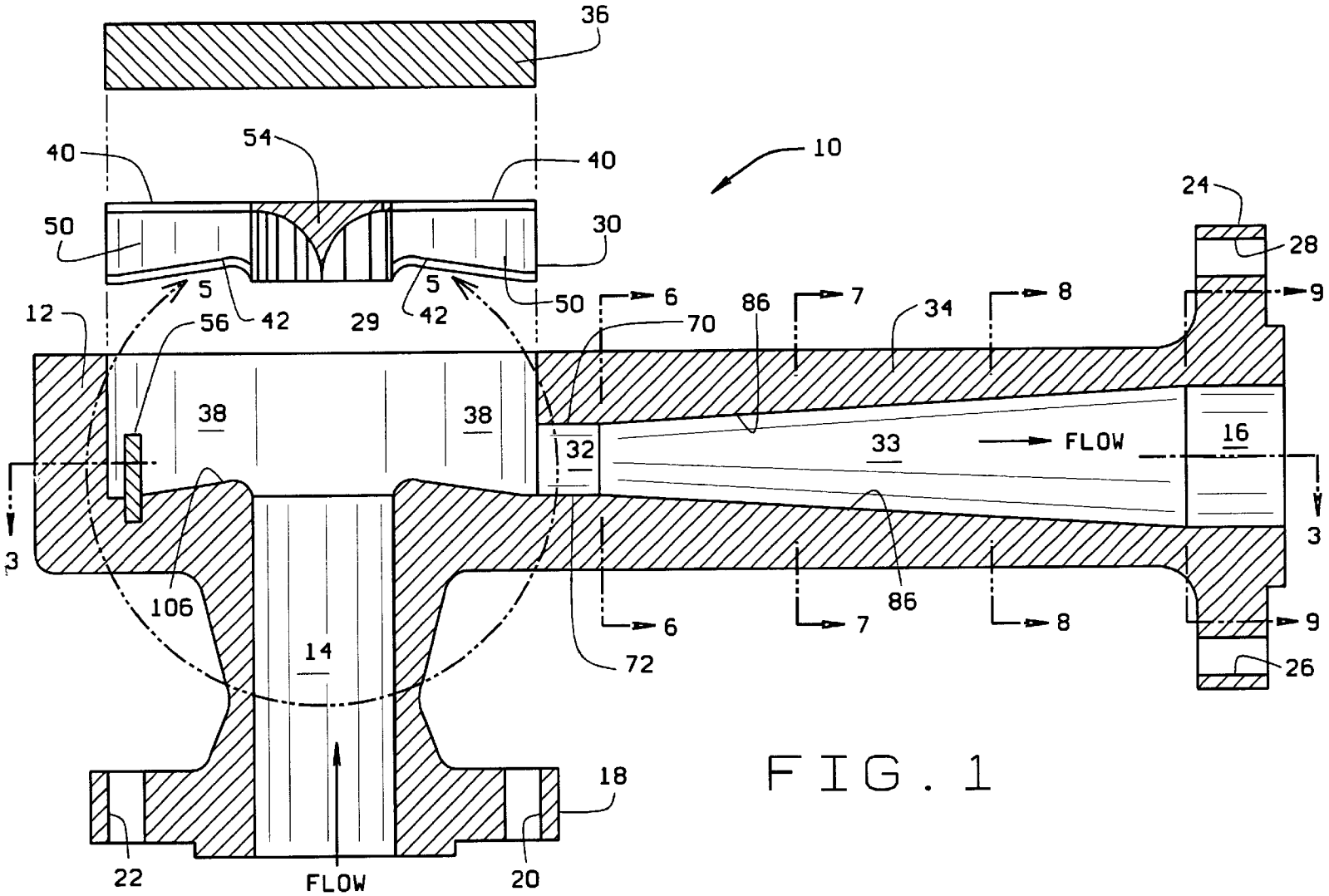
FIG. 1 is a section view of the elbow with the flow conditioner and cap in exploded view.

Referring now to FIG. 1, a flow diffuser is generally identified by the numeral 10 and is shown in exploded view. The top of the flow diffuser 10 is generally identified by the arrow 11 and the bottom is generally identified by its numeral 13. The flow diffuser is configured as a 90° elbow 10 to be used in a piping system, not shown. The flow diffuser 10 has a body 12 which defines an inlet 14 and an outlet 16. An inlet conduit, not shown in the drawing, has a flange that aligns and mechanically connects by a bolt circle to the inlet flange 18 of the elbow 10. The inlet flange 18 has a plurality of bolt holes, for example at 20 and 22 which receive the bolts for securing the inlet conduit flange to the inlet flange 18 of the elbow 10. An outlet conduit, not shown in the drawing, has a flange which aligns and is connected to the outlet flange 24 of the elbow 10 by a bolt circle. The outlet flange 24 of the flow diffuser 10 has a plurality of bolt holes, for example at 26 and 28 which align with the bolt holes in the outlet conduit flange. The alignment and connection of the inlet conduit flange and the outlet conduit flange to the flanges 18 and 24 of the elbow 10 in a piping system is well known to those skilled in the art.

To reduce turbulence, the inside diameter of the inlet 14 should be about the same as the inside diameter of the inlet conduit. To reduce turbulence, the inside diameter of the outlet 16 should be about the same as the inside diameter of the inlet conduit. To reduce turbulence, the inside diameter of the outlet conduit should also be about the same as the inside diameter of the inlet conduit.

In FIG. 1 bolt holes 20, 22, 26 and 28 are shown at a 12 o'clock and 6 o'clock position merely for illustrative purposes. One skilled in the art will recognize that the actual locations of these bolt holes are out of hand about 16° from the position shown in these drawings for a 4 inch flange.

As indicated by the arrow in FIG. 1, fluid flows into the inlet 14, past the throat 29, through the flow conditioner 30, into the transition zone 32, through the discharge passageway 33 of the elongate tapered discharge nozzle 34, through the outlet 16, and finally into the outlet conduit, not shown in the drawing. The present invention can be used with liquids, such as water, gasoline, diesel and other hydrocarbons. It can also be used with gases, including natural gas and/or other hydrocarbons. It can be used for two-phase flow, such as a cold slurry or natural gas with entrained liquids. It can also be used with three-phase flow, such as oil, water and gas. It can be used with steam and it can be used with dry particulate or granules. For purposes of this application, all of the foregoing will simply be referred to as fluid.

The elbow 10 includes a removable cap 36. The cap 36 can be threadably attached to the body 12, it can be welded to the body 12, or attached by other means well known in the art. From an operational perspective, the elbow includes three primary components: a flow conditioner 30, a transition zone 32, and a discharge passageway 33 in the elongate tapered discharge nozzle 34. As a matter of manufacturing convenience, the flow conditioner 30 can be manufactured as a separate part that is inserted into receptacle 38 in the body 12 by removing the cap 36. Once the removable flow conditioner 30 is inserted into the receptacle 38 of the body 12, the cap 36 is replaced and secured. In some conditions, the flow conditioner may experience more wear than other components in the elbow 10. To facilitate maintenance and prolong the life of the elbow 10, the flow conditioner is replaceable.

When fluid passes through a conventional 90° elbow in a piping system, turbulence is generated because of the 90° turn. Conventional wisdom indicates that laminar flow does not return to the fluid stream after it passes through a 90° elbow until as much as 40 to 50 pipe diameters past the elbow (assuming an axially aligned straight discharge pipe having the same inside diameter as the elbow). For example, with a conventional 2 inch elbow and 2 inch piping system, laminar flow may not return until as much as 80 inches to 100 inches downstream of the elbow. It is desirable for many reasons to restore laminar flow as quickly as possible after a fluid passes through a 90° elbow. A length of 40 or 50 pipe diameters is simply impractical in many real world applications.

The present invention restores substantially laminar flow to a fluid stream after it passes through the 90° turn within about 4 pipe diameters after the transition zone 32. Reducing the distance necessary to achieve substantially laminar flow from 40 or 50 pipe diameters to about 4 pipe diameters is an advantage in a number of situations, especially in close quarters, such as offshore drilling or production platforms. In addition, the elbow 10 is able to restore laminar flow after the fluid passes through this 90° turn with reduced noise and vibration when compared with a conventional elbow. Reduction in noise and vibration is accomplished because of the reduced turbulence in the elbow 10 when compared with prior art elbows.

To function properly, the flow conditioner 30 must be aligned properly in the receptacle 38. To ensure proper alignment, an aligning pin 56 is mounted in the body 12 and the pin 56 protruded into the receptacle 38. An aperture is formed in the flow conditioner 30 and is shaped to receive the pin 56. When the removable flow conditioner 30 is inserted in receptacle 38, proper alignment is assured because the pin 56 must register with the hole for the flow conditioner 30 to sit flat in the receptacle 38. Other aligning means may also be used which are well known to those skilled in the art. For example, a slot could be formed in the flow conditioner 30 which registers with a lug extending from the body 12 into the receptacle 38. In the alternative, aligning key ways could be formed in the body 12 and the flow conditioner 30 to receive a key to ensure proper alignment.

Figure 2:
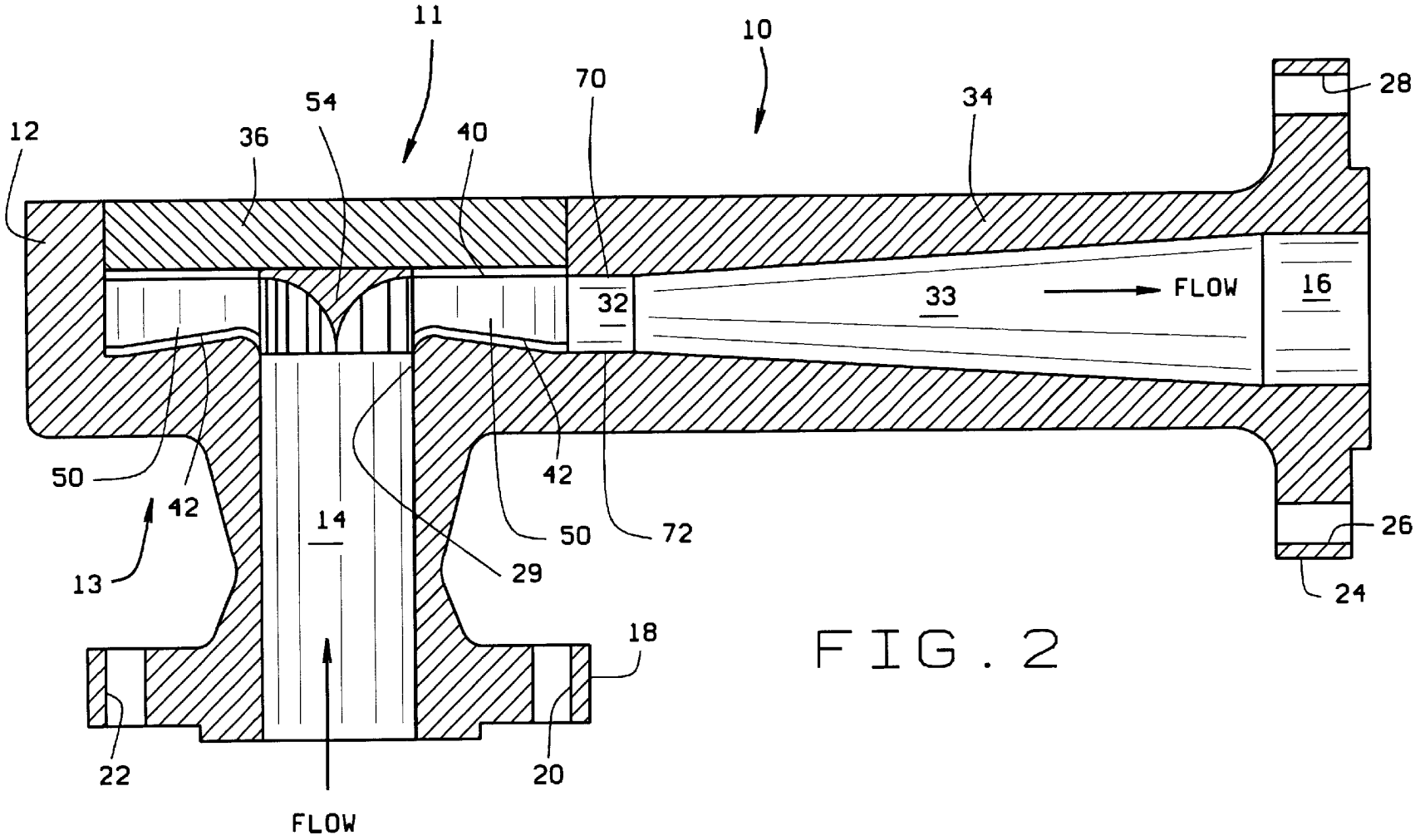
FIG. 2 is a section view of the elbow of FIG. 1 with the flow conditioner and cap fully assembled.

FIG. 2 is a section view of the elbow 10 of FIG. 1, with the cap 36 and flow diffuser 30 assembled for operation. The flow conditioner 30 has a top 40 and a bottom 42. The guide vanes 50 *a–q* are positioned between the top 40 and the bottom 42 of flow conditioner 30. The flow conditioner 30 also includes a side wall 44 which extends from the top surface 40 to the bottom surface 42. The side wall 44, the top 4 and the bottom 42 contain the fluid flow in the flow conditioner 30. The flow conditioner 30 includes an outlet port identified generally by the dotted curved line 46 better seen in FIG. 3. The outlet port 46 is defined by the side wall 44, the top surface 40 and the bottom surface 42 of the flow conditioner 30.

Figure 3:
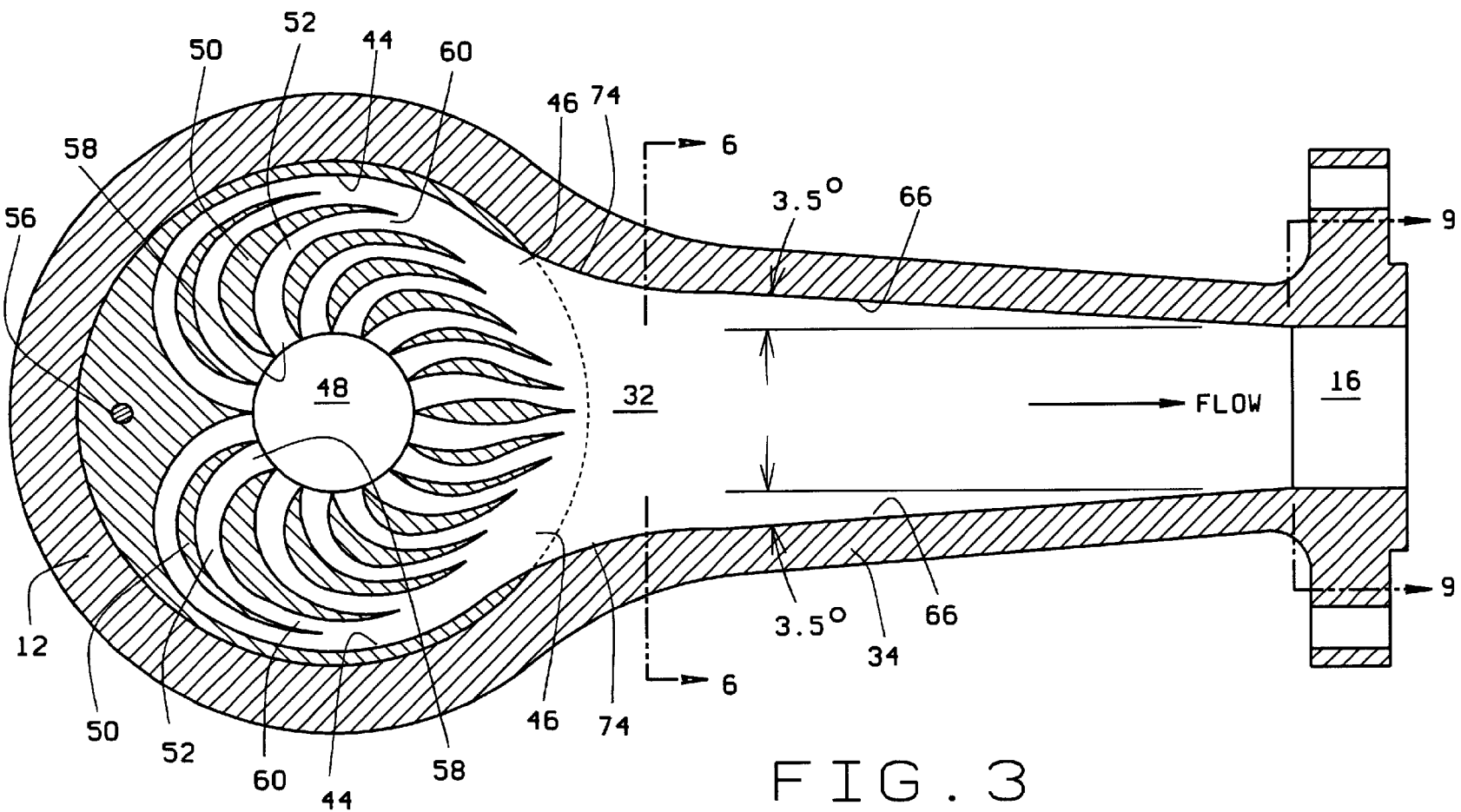
FIG. 3 is a section view of the elbow along the line 3—3 of FIG. 1.

The inlet 14 feeds the fluid into an inlet zone 48 better seen in FIG. 3. A generally conical protrusion 54 extends from the top 36 into the inlet zone 48. The area of the inlet zone 48 is reduced by the area of the generally conical protrusion 54; however, in the preferred embodiment, the inlet zone 48 has an area at least twice the cross-sectional area of the inlet 14.

FIG. 3 is a section view of the elbow 10 along the line 3—3 of FIG. 1 except the conical protrusion 54 is not shown. In other words, FIG. 3 is a section view of the elbow 10 viewed from the top 11. A positioning pin 56 is mounted in the body 12 and extends into the receptacle 38. The pin 56 aligns with a hole in the flow conditioner 30 to properly position the flow conditioner 30 in the receptacle 38. An aligning pin 56 also prevents the flow conditioner 30 from moving during operation of the apparatus and aligns the vanes for proper operation of the elbow. Vanes 50*a–p* define a plurality of curvilinear passageways 52*a–q*. In the preferred embodiment, 16 passageways are shown; however, a larger number or a smaller number of passageways can be used depending on the fluid matrix, pressure, pipe size and other operational parameters. The side wall 44 of the flow conditioner 30 together with the top 40 and the bottom 42 direct fluid flow as it exits the passageways 52*a–q*. The guide vanes have a generally heart-shaped outline. Each passageway 52 has a beginning 58 and an ending 60. The beginning 58 in fluid communication with the inlet zone 48 and the ending 60 is in fluid communication with the transition zone 32. In the preferred embodiment, the area of each beginning 58 has a cross-sectional area that is about twice as large as the cross-sectional area of the end 60. The width of each passageway 52 at the beginning 58 is preferably equal to the circumference of the inlet zone 48 divided by the number of passageways 52. The area of the beginning 58 and the end 60 at the width of each passageway 52 may be adjusted depending on the fluid matrix, pressure, pipe size and other operational parameters.

The taper of the discharge nozzle 34 is important to reduce turbulence of the fluid as it passes from the transition zone 32 towards the outlet conduit. Applicant prefers a taper with an included angle of about 5°–7.5°. The included angle of taper will determine the length of the discharge nozzle 34 as shown in the table below.

Discharge Nozzle Lengths

| Diameter of Inlet Conduit | 7° Included Angle | 5° Included Angle |
|---|---|---|
| 1" | App. 4.1" | App. 6.53" |
| 2" | App. 8.2" | App. 13.05" |
| 4" | App. 16.4" | App. 26.11" |
| 6" | App. 24.5" | App. 39.16" |
| 8" | App. 32.7" | App. 52.22" |
| 12" | App. 49.1" | App 78.33" |

As indicated in this table, a discharge nozzle 34 tapered at a 7° included angle will have a length approximately 4 times the diameter of the inlet conduit. A discharge nozzle tapered at a 5° included angle will be longer and have a length approximately 6½ times the diameter of the inlet conduit.

As shown in FIG. 3, the interior surface 66 of the discharge nozzle 34 has a taper of 3.5° on all surfaces as measured from lines extended parallel to the outlet conduit. The tapered discharge nozzle 34 extends from the line 6—6 to the line 9—9. The parallel lines in the drawing extend parallel to the walls of the outlet 16. The outlet 16 has parallel sides aligned with the outlet conduit to reduce turbulence.

Figure 4:
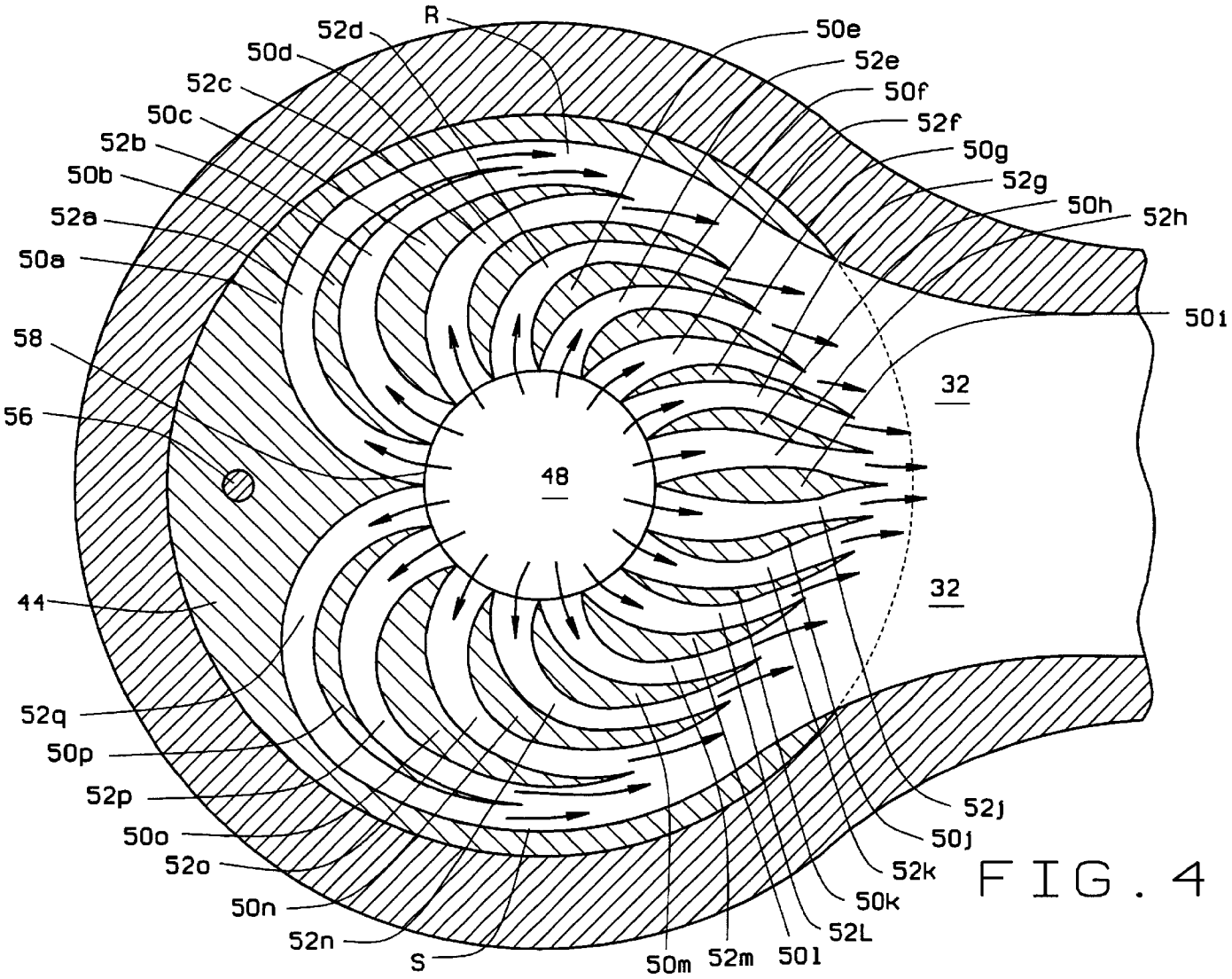
FIG. 4 is an enlarged partial section view of flow conditioner, vanes and passageways of FIG. 3.

In FIG. 4, an enlarged section view of the flow conditioner 30 similar to the view in FIG. 3 without the conical protrusion 54. Fluid flows from the inlet 14 into the inlet zone 48 which has a larger area than the cross-sectional area of the inlet 14. The fluid encounters the conical protrusion 54, the guide vanes 50*a–p* and the beginning 58 of each curvilinear passageway 52*a–q* as shown by the flow arrows. The fluid then passes through the passageways 52*a–q* and moves into the transition zone generally identified by the numeral 32. The transition zone 32 is defined by an upper portion 70 and a lower portion 72 of the body 12 and a curved outer wall 74, which is likewise a portion of the body 12. In the preferred embodiment, the curved outer wall 74 has a radius about 2½ times the diameter of the inlet 14. The transition zone 32 is in fluid communication with the outlet opening 46 of the flow conditioner 30, and the elongate tapered discharge nozzle 34. The diameter of the flow conditioner from point R to point S in the preferred embodiment is approximately 3 times the diameter of the inlet 14.

Figure 5:
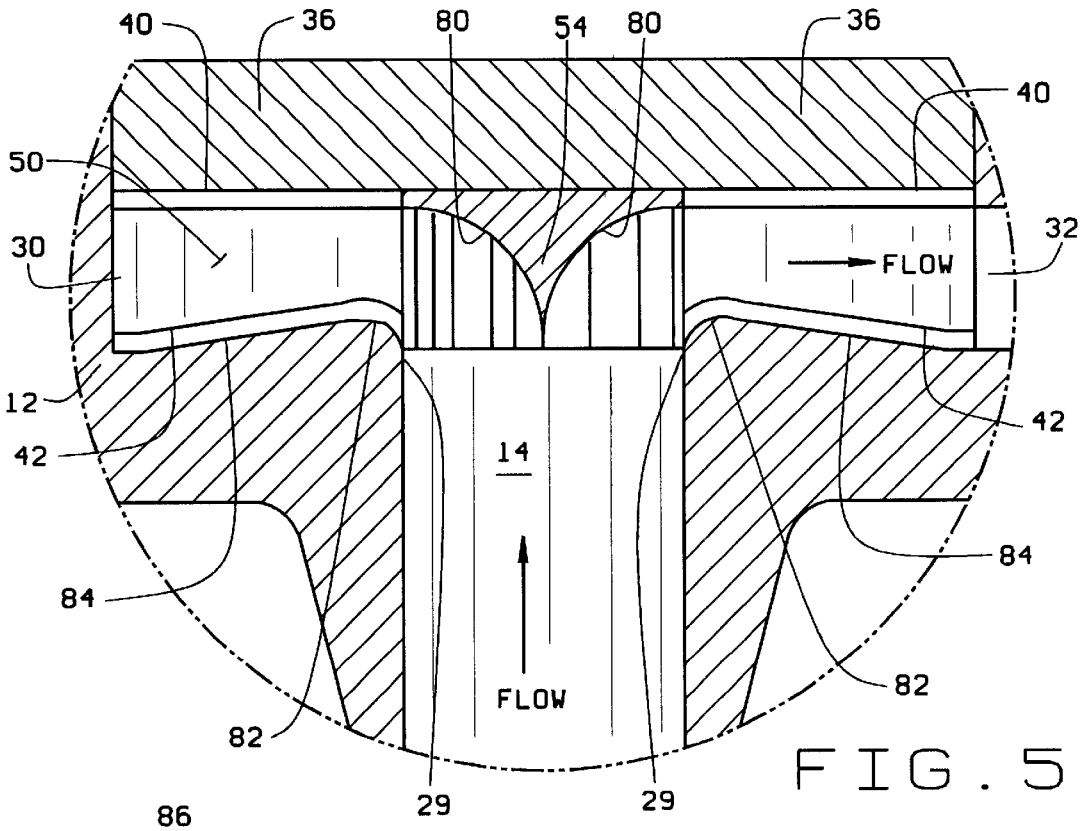
FIG. 5 is an enlargement of the inlet, and flow conditioner along the line 5—5 of FIG. 1.

FIG. 5 is an enlarged section view of the flow conditioner 30 along the line 5—5 of FIG. 1. The flow conditioner 30, the top 36 and the surrounding body portions 12 are shown in greater detail. The conical protrusion 54 extends into the inlet zone 48. The conical protrusion 54 has a symmetric concave surface 80. In the preferred embodiment, the radius of the concave surface 80 is about equal to the radius of the inlet 14. However, other radiuses are suitable and, in fact, the protrusion 54 can be shaped as a pure cone instead of a generally concave surface. A streamlined shoulder 82 completely surrounds the throat 29. The radius of the streamlined shoulder is about ⅛ the diameter of the inlet 14. The ramp 84 extends from this radius as a tangent taken on a 90° angle.

Figure 6:
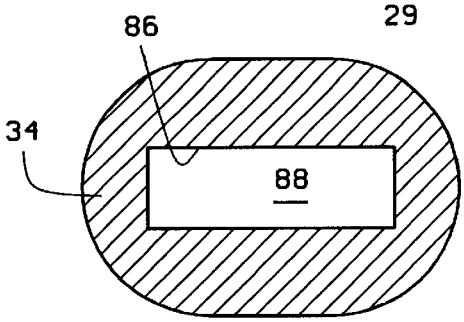
FIG. 6 is a section view of the rectangular inlet of the discharge passageway in the discharge nozzle at the line 6—6 of FIG. 1.

FIG. 6 is a section view of the discharge nozzle 34 along the line 6—6 of FIG. 1. The interior surface 86 of the discharge nozzle 34 defines a discharge passageway 33 with a generally rectangular shaped inlet 88. In the preferred embodiment, the height of the rectangular shaped inlet 88 is about ½ the diameter of the inlet 14 and the width of the rectangular inlet 88 is about 1.5 times the diameter of the inlet 14. However, other dimensional configurations for this rectangle fall within the scope of this invention and may be adjusted, depending upon the fluid matrix, pressure, pipe size, and other operational parameters.

Figure 7:
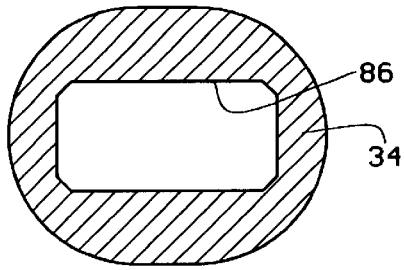
FIG. 7 is a section view of the polygonal interior surface of the discharge passageway in the discharge nozzle at the line 7—7 of FIG. 1.

FIG. 7 is a section view of the discharge nozzle 34 along the line 7—7 of FIG. 1. The interior surface 86 begins to change shape from the generally rectangular inlet 88 to a polygon as shown in the drawing. Other polygonal shapes fall within the scope of this invention, provided that the interior surface 86 maintains a taper with an included angle of about 5°–7.5°.

Figure 8:
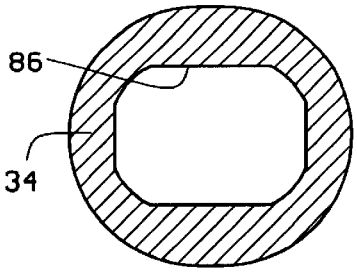
FIG. 8 is a section view of the polygonal interior surface of the discharge passageway in the discharge nozzle at the line 8—8 of FIG. 1.

FIG. 8 is a section view of the discharge nozzle 34 along the line 8—8 of FIG. 1. The interior surface 86 is polygonal. Other polygonal shapes fall within the course of this invention, provided that they are tapered as discussed above.

Figure 9:
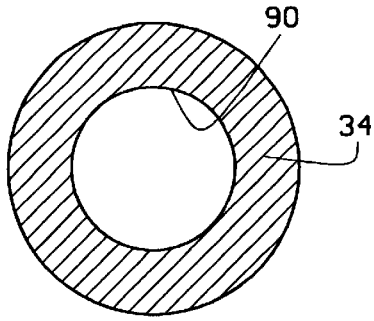
FIG. 9 is a section view of the circular outlet of the discharge passageway in the discharge nozzle at the line 9—9 of FIG. 1.
Figure 10:
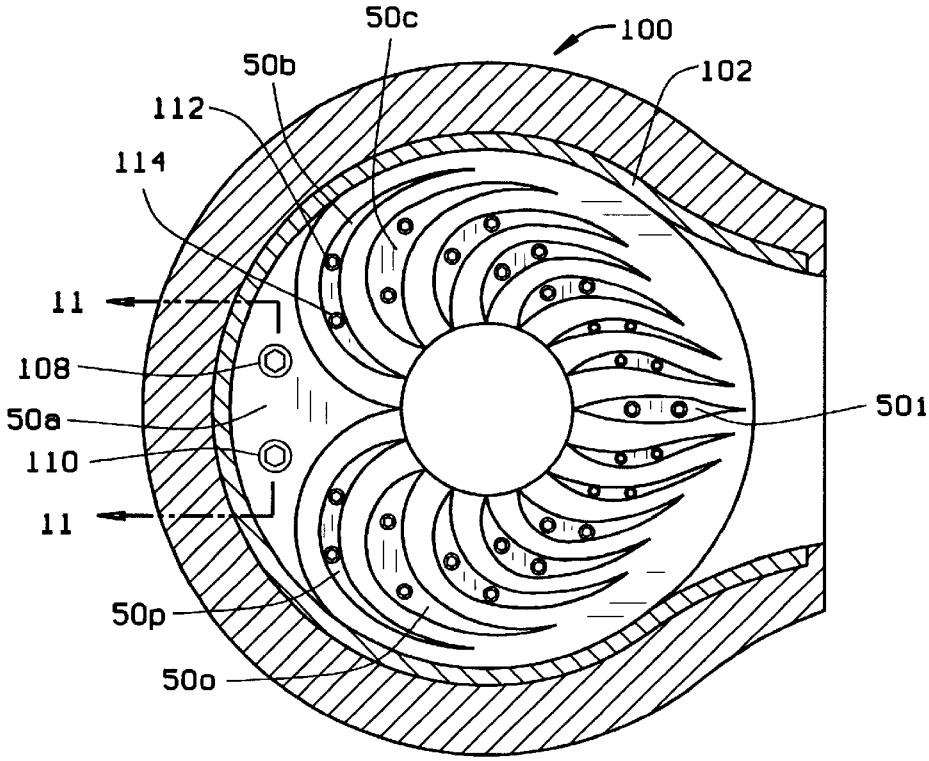
FIG. 10 is a partial section view of an alternative embodiment of the elbow with replaceable vanes and side wall.

FIG. 9 is a section view along the line 9—9 of FIG. 1 showing the discharge nozzle 34 as it converges to a circular outlet 90. The diameter of the circular outlet 90 is approximately equal to the diameter of the inlet 14. The inlet conduit and the outlet conduit should be approximately equal in diameter and cross-sectional area to reduce turbulence. The cross-sectional area of the discharge passageway 33 as it extends from line 6—6 to line 9—9 should be approximately the same. The rectangular shaped discharge passageway 88 should have approximately the same cross-sectional area as the circular outlet 90. The length of the discharge nozzle 34 from the line 6—6 to the line 9—9 for a 7° included angle is about 4 times the diameter of the inlet 14. The length of the discharge nozzle 34 from the line 6—6 to the line 9—9 with a 5° included angle is about 6½ times the diameter of the inlet 14. FIG. 10 the elbow 10 is viewed from the bottom 13.

FIG. 10 is a partial section view of an alternative embodiment of the flow conditioner generally identified by the numeral 100. In this alternative embodiment, each vane 50*a*–50*p* is replaceable. In this alternative embodiment, the side wall 102 is also replaceable. In this embodiment, the top of the flow conditioner 100 is formed from a flat plate 101. The bottom 106 of this flow conditioner is formed by the receptacle 38. In other words, this flow conditioner 100 does not have the same top 40 and the bottom 42 as the flow conditioner 30. These differences are necessitated primarily by the different fluid matrices and other operational parameters that may vary from application to application and different manufacturing preferences.

In some situations with uniform wear characteristics, it will be easier and cheaper to replace the unitized flow conditioner 30 of FIG. 1. The unitized flow conditioner 30 also isolates and protects the body 12, the cap 36 and the receptacle 38 from the erosive effects of the fluid which may in some situations prolong the life of the elbow. In other situations, it may be easier and cheaper to replace only a few selected vanes of the alternative embodiment shown in FIG. 10. The apparatus of FIG. 10 allows the fluid to come into contact with the plate 101 and the bottom 106 of the receptacle 38. In some applications, this is desirable and in others it may be undesirable. If wear and erosion on the body becomes severe, the unitized flow conditioner 30 of FIG. 1 is preferable. If wear on the vanes is more severe, then the flow conditioner 100 of FIG. 10 may be a better choice.

The vane 50*a* is secured by a first bolt 108 and a second bolt 110 to the plate 101. Likewise, vane 50*b* is secured by a first bolt 112 and a second bolt 114 to the plate 101. Each of the other vanes 50*c*–50*p* are likewise each attached by two bolts to the plate 101.

Figure 11:
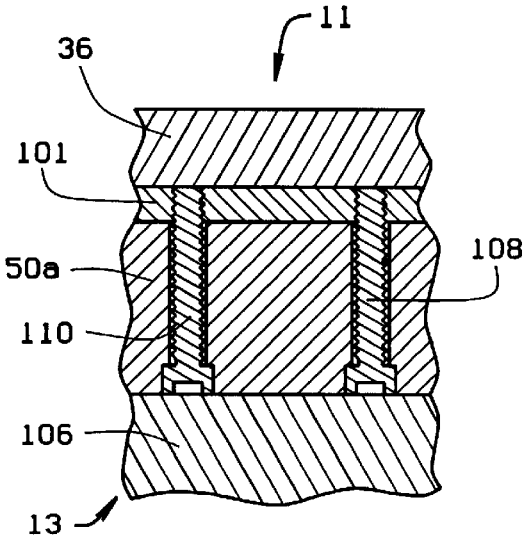
FIG. 11 is a section view of a vane attached with screws to the body along the line 11—11 of FIG. 10.

FIG. 11 is a cross-section view along line 11—11 of FIG. 10. A portion of the vane 50*a* is shown in section view along with bolts 108 and 110. These bolts threadably engage the plate 101. The plate 101 abuts the cap 36 on the topside of the elbow 10 and protects the cap 36 from fluid flow. The bottom edge of the vane 50*a* about the bottom 106 of the receptacle 38.

Figure 12:
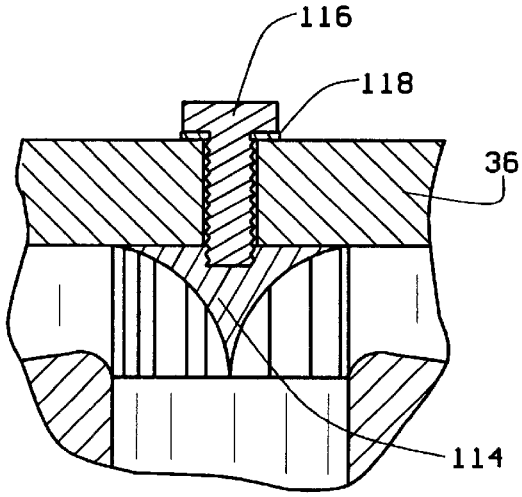
FIG. 12 is a section view of the cap, a screw and removable cylindrical tip.

FIG. 12 is a cross-section view of the top 36 and a removable conical tip 114. A bolt 116 passes through a hole in the top and is sealed by washer 118. The bolt 116 threadably engages the removable conical tip 114. The removable conical tip 114 can be used in conjunction with the flow diffuser 100 shown in FIG. 10. This allows selective removal and replacement of wear parts, i.e. the conical tip 114, the vanes 50*a*–50*p* and the side wall 102. In certain situations, the ability to selectively remove and replace worn parts may have advantages over removal and replacement of the integral flow conditioner 30 of FIG. 1.

Repair kits for the flow conditioner shown in FIGS. 10, 11 and 12 would include replaceable vanes 50*a*–*p*, screws, the replaceable side wall 102 and replaceable conical tip 114.

Figure 13:
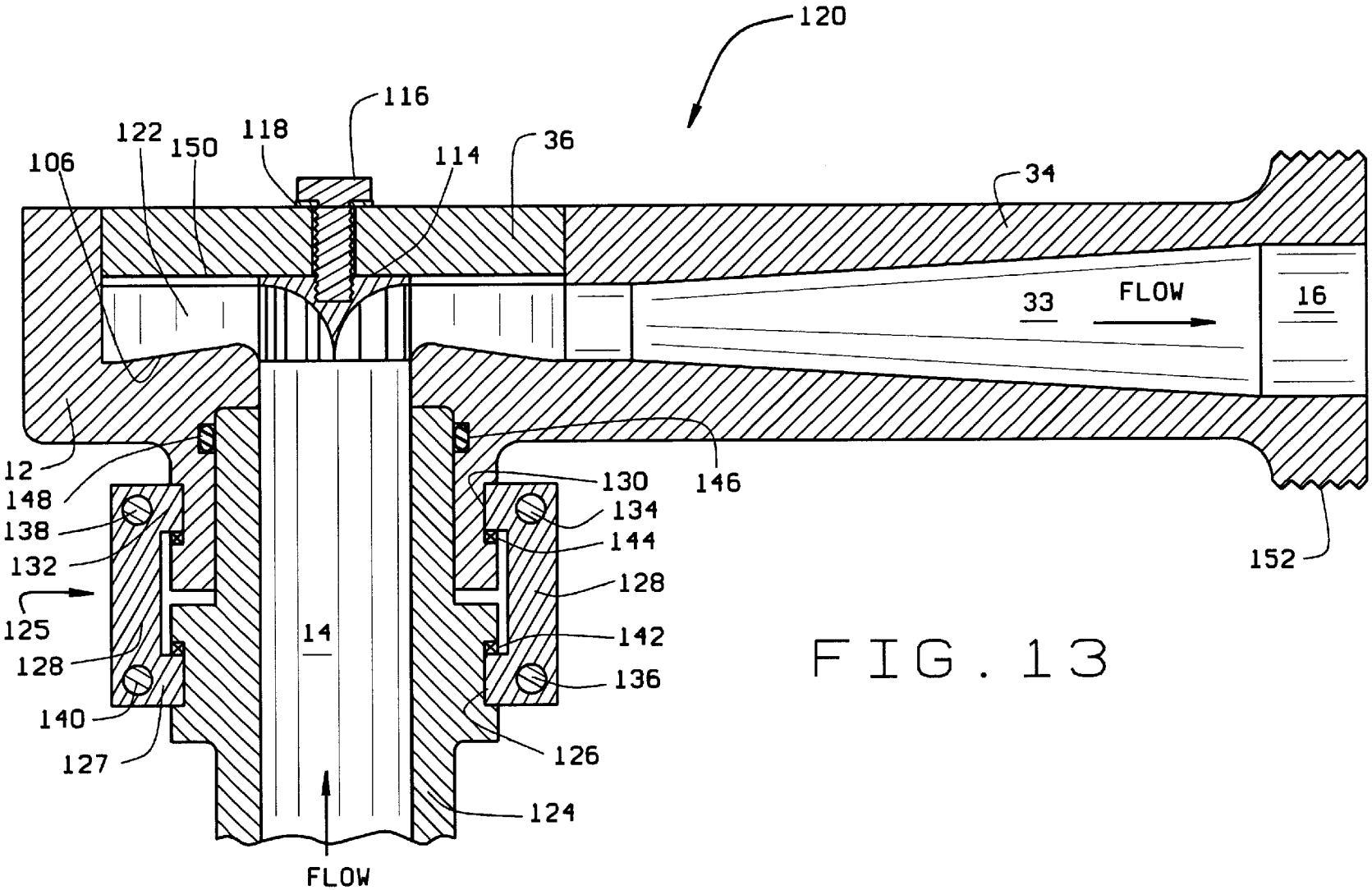
FIG. 13 is a section view of an alternative embodiment of the elbow that can be used in conjunction with a fire hydrant.

FIG. 13 shows a cross-section view of another alternative embodiment of the diffuser that may be used on a fire hydrant. In this embodiment, the elbow generally identified with the numeral 120 can rotate to facilitate connection of a fire hose to the fire hydrant. The hose and hydrant are not shown in this drawing. Also another embodiment of the flow conditioner 122 is shown.

The fire hydrant is designed with a special outlet 124. A yoke assembly is generally identified by the numeral 125. The outlet 124 forms a circumferential channel 126 that receives one side of a circular yoke 128. The body 12 likewise forms a circumferential channel 130 that receives the other side 132 of the yoke 128. The yoke is secured by cross bolts 134, 136, 138 and 140. The yoke 128 is sealed in a circular channel 126 by an o-ring 142 and in channel 130 by an o-ring 144. This yoke 128 thus allows the elbow 120 to rotate about the fire hydrant outlet 124 to make hose attachment easier. The outlet 124 is further sealed against the body 12 by an o-ring 146 positioned in o-ring groove 148. The yoke assembly 125 includes the yoke 128, the cross bolts 134, 136, 138 and 140, and the o-ring seals 142, 144 and 148.

In this alternative embodiment, the flow conditioner 122 has a flat top plate 150 that is connected to the vanes 50*a*–50*p*. The bottom of the flow conditioner 122 is formed by the bottom 106 of the receptacle 38. In other words, the fluid comes in contact with the bottom 106 of the receptacle 38. In this embodiment, the conical tip 114 is also removably attached to the cap 36 by bolt 116 as shown in FIG. 12. This allows replacement of the tip 114 without having to replace the entire flow conditioner 112. Threads 152 are formed on the end of the discharge nozzle 34 to threadably engage the coupling on the end of a fire hose, not shown. The flow conditioner 122 with slight modifications to the body 12 can be used in lieu of the flow conditioner 30 in FIG. 1 or in lieu of the flow conditioner 100 of FIG. 10.

Again, this embodiment of the flow conditioner 122 may have advantages in certain applications over the embodiment shown in FIG. 10 or the embodiment of FIG. 1, depending on where erosion and wear is most pronounced. The embodiment of FIG. 13 may also be easier to manufacture than the embodiment in FIG. 1. However, the embodiment of FIG. 13 allows the fluid to contact the body 12 at the bottom 106 of the receptacle 38. This may or may not be a disadvantage based on the application. At present, Applicant believes that the flow conditioner 122 of FIG. 13 is the best mode because it isolates fluid flow from contact with the cap 36 and presently is the easiest to manufacture.

It may be that wear is not a problem and manufacturing convenience is the primary issue. Regardless of how it is configured, the flow conditioner includes at a minimum, a top, a bottom, a side wall, and a plurality of vanes. In the best mode is also includes a generally conical tip which may or may not be removable.

While the foregoing is directed to the preferred embodiments of the present invention, other and further embodiments of the invention may be devised without departing from the basic scope thereof, and the scope thereof is determined by the claims which follow.

Figure 14:
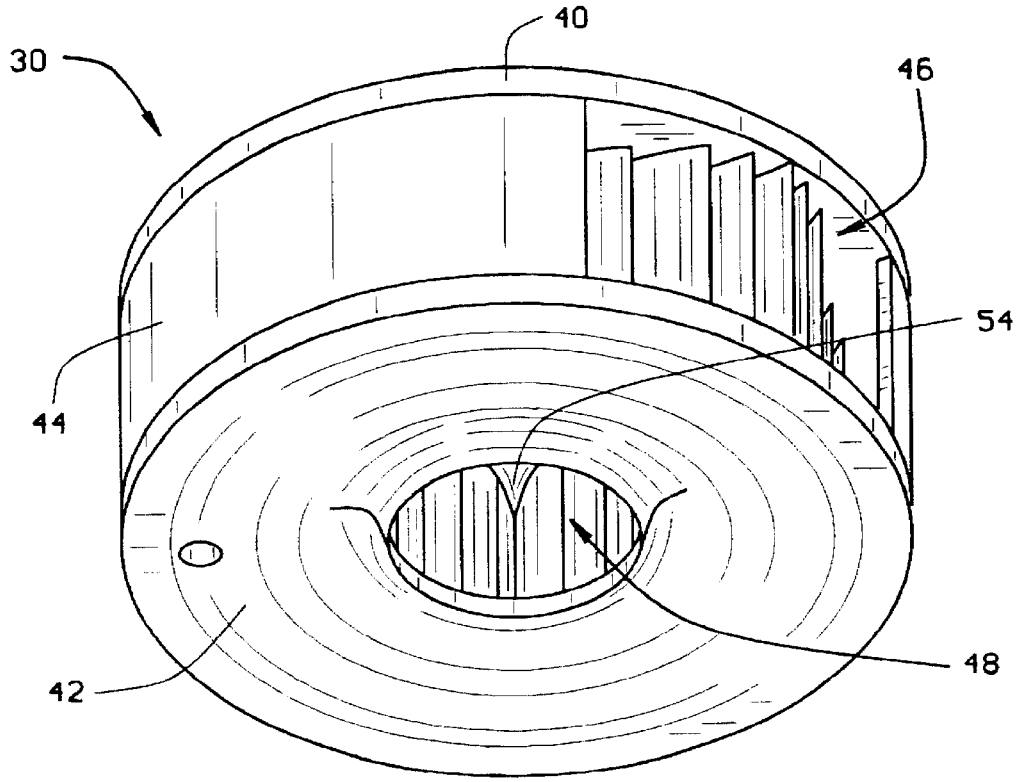
FIG. 14 is a bottom perspective view of the flow conditioner of FIGS. 1–5.

FIG. 14 is a bottom perspective view of the flow conditioner 30 of FIGS. 1–5. The top surface 40 is flat. The bottom surface 42 is curvilinear. The sidewall 44 connects the top surface 40 and the bottom surface 42. The outlet port 46 is defined by the sidewall 44; the top surface 40 and the bottom surface 42 of the flow conditioner 30. The circular inlet zone is generally identified by the numeral 48.

Figure 15:
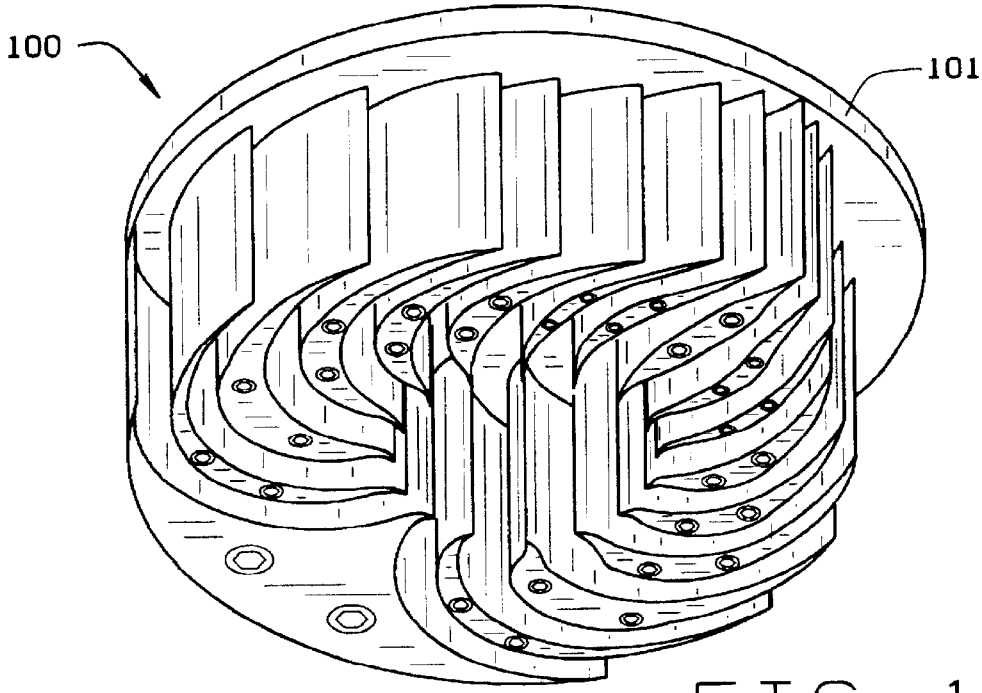
FIG. 15 is a bottom perspective view of the flow conditioner of FIGS. 10 and 11.

FIG. 15 is a bottom perspective view of the flow conditioner 100 of FIGS. 10 and 11. This second embodiment has removable vanes that attach to a flat top plate 101 via a plurality of screws. The bottoms of the vanes are curvilinear.

Figure 16:
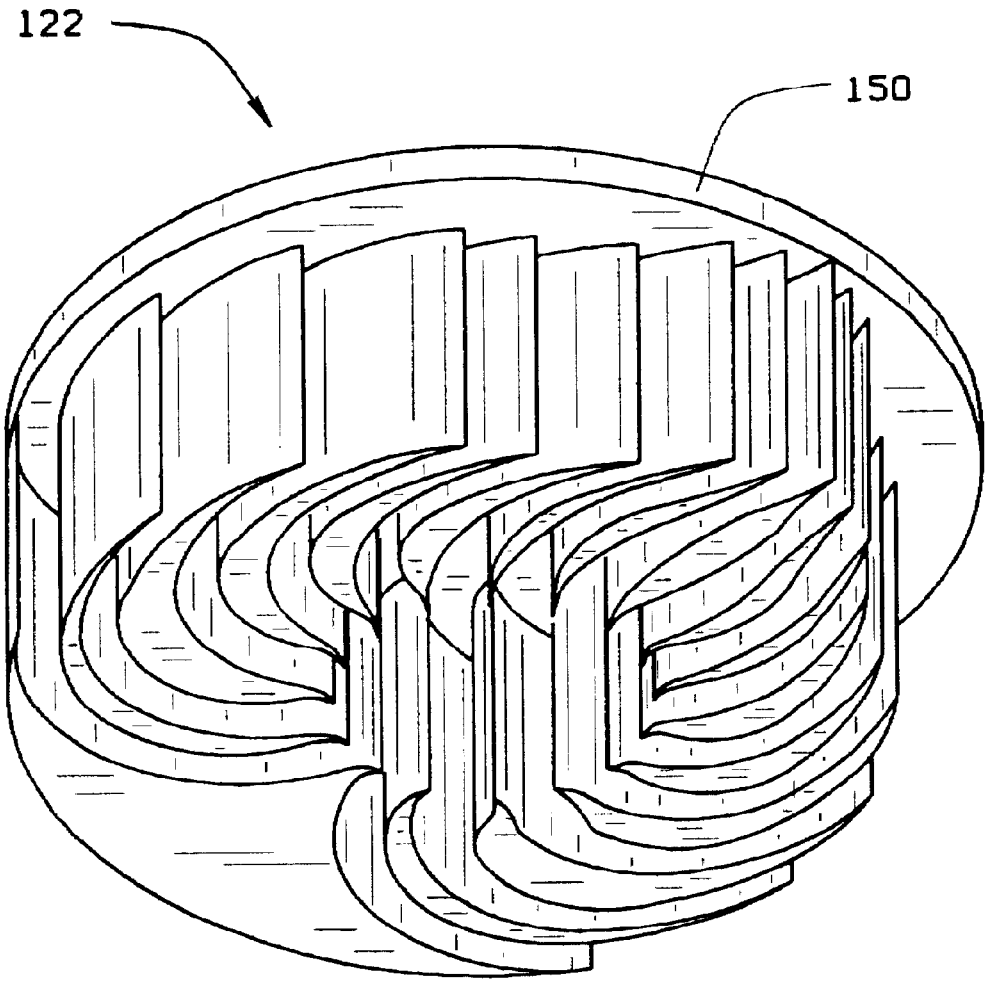
FIG. 16 is a bottom perspective view of the flow condition of FIG. 13.

FIG. 16 is a bottom perspective view of the flow conditioner 122 in FIG. 13. This third embodiment has a flat top plate and the vanes are rigidly attached thereto. The bottoms of the vanes are curvilinear.

It should be understood that the three embodiments of the flow conditioner 30 of FIG. 14, 100 of FIG. 14 and 122 of FIG. 16 may be used in the elbow 10 or on the fire hydrant of FIG. 13, depending on the application. All three have flat tops and curvilinear bottoms.

At present, Applicant believes that the third embodiment of FIG. 16 is the best mode and recommends it for both the elbow 10 of FIG. 1 and the fire hydrant of FIG. 13.

What is claimed is:

1. A diffuser connected to an inlet conduit and an outlet conduit to reduce turbulence as fluid flows from the inlet conduit through the diffuser to the outlet conduit comprising:

a body defining an inlet and an outlet;

a removable flow conditioner having a top, a bottom, an inlet port in said bottom, and a side wall joining said top surface and said bottom surface, the side wall extending at least 180° about the removable flow conditioners including:

said inlet port having a diameter at least equal to the diameter of said inlet, there being fluid communication between the inlet conduit, said inlet and said inlet port;

an outlet port defined by said side wall, said top and said bottom;

an inlet zone having an area at least twice the cross-sectional area of said inlet port, there being fluid communication between the inlet conduit, said inlet, said inlet port, and said inlet zone;

a protrusion extending from said top into said inlet zone;

a plurality of stationary guide vanes defining a plurality of curvilinear passageways, each passageway having a beginning in fluid communication with said inlet zone and each passageway having an end in fluid communication with said outlet port, each of said vanes extending from said bottom to said top of said removable flow conditioner;

each of said curvilinear passageways having a cross-sectional area at said beginning that is at least twice as large as the cross-sectional area at said end;

a transition zone defined by said body, said transition zone in fluid communication with said outlet port of said flow conditioner;

an elongate tapered discharge nozzle including:

an elongate tapered interior surface defining a discharge passageway with a generally rectangular shaped inlet and a circular outlet, said rectangular inlet in fluid communication with said transition zone and said circular outlet in fluid communication with the outlet conduit;

said discharge passageway having a length at least twice as long as the diameter of the inlet; and said discharge passageway having a generally constant cross-sectional area.

2. The apparatus of claim 1 further including a removable cap to gain access to said removable flow conditioner.

3. The apparatus of claim 1 wherein said elongate interior surface tapers at an included angle between 5–7.5 degrees.

4. The apparatus of claim 1 wherein said elongate interior surface tapers at an included angle of about 7 degrees.

5. The apparatus of claim 1 further including a streamlined shoulder in said bottom surface surrounding a throat.

6. The apparatus of claim 1 wherein a streamlined shoulder is a radius about ⅛ the diameter of said throat.

7. The apparatus of claim 1 wherein said protrusion is generally conical and has a symmetric concave surface.

8. The apparatus of claim 7 wherein said concave surface has a radius about equal to the radius of the inlet conduit.

9. The apparatus of claim 1 wherein said curved outer wall of a transition zone has a radius about 2.5 times greater than the radius of said inlet.

10. The apparatus of claim 1 wherein said generally rectangular shaped inlet of said discharge passageway has a height about equal to the radius of said inlet and a length about 1.5 times the diameter of said inlet.

11. The apparatus of claim 1 wherein the length of said elongate tapered discharge nozzle is about four times the diameter of the inlet to reduce turbulence as fluid flows from the inlet conduit through the diffuser to the outlet conduit.

12. A replaceable flow conditioner for controlling fluid flow comprising:

a generally flat top;

a bottom having an inlet port formed therein;

a side wall joining said top and said bottom, the side wall extending at least 180° about the replaceable flow conditioner;

a generally central inlet zone in fluid communication with said inlet port;

a plurality of vanes extending from said top to said bottom together defining a plurality of fluid passageways beginning at said inlet zone and leading to an outlet port; and said flow conditioner directing fluid flow as it passes through said inlet port, into said outlet zone, through said passageways and exits through said inlet port.

13. The apparatus of claim 12 wherein the replaceable flow diffuser further includes a generally conical tip extending from said top into said inlet zone.

14. The apparatus of claim 13 wherein the replaceable flow diffuser further includes an alignment aperture.

15. A flow diffuser connected to an inlet conduit and an outlet conduit to reduce turbulence as fluid flows from the inlet conduit through the diffuser to the outlet conduit comprising:

a body defining an inlet and an outlet;

said body defining a flow conditioner having a top surface, a bottom surface, an inlet port in said bottom surface, and a side wall joining said top surface and said bottom surface, including:

said inlet port having a diameter at least equal to the diameter of said inlet, there being fluid communication between the inlet conduit, said inlet and said inlet port;

an inlet port defined by said side wall, said top surface and said bottom surface of said flow conditioner;

an inlet zone having an area at least twice the cross-sectional area of said inlet port, there being fluid communication between the inlet conduit, said inlet, said inlet port, and said inlet zone;

a protrusion extending from said top surface into said inlet zone;

a plurality of removable guide vanes positioned in said flow conditioner, said guide vanes defining a plurality of curvilinear passageways, each passageway having a beginning in fluid communication with said inlet zone and each passageway having an end in fluid communication with said outlet port, each of said vanes extending from said bottom surface to said top surface of said flow conditioner;

each of said curvilinear passageways having a cross-sectional area at said beginning that is at least twice as large as the cross-sectional area at said end;

a transition zone defined by said body, said transition zone and fluid communication with said outlet port of said flow conditioner;

an elongate tapered discharge nozzle including:

an elongate tapered interior surface defining a discharge passageway with a generally rectangular shaped inlet and a circular outlet, said rectangular inlet in fluid communication with said transition zone and said circular outlet in fluid communication with the outlet conduit;

said discharge passageway having a length at least twice as long as the diameter of the inlet; and said discharge passageway having a generally constant cross-sectional area.

16. A diffuser connected to an inlet conduit and an outlet conduit to reduce turbulence as fluid flows from the inlet conduit through the diffuser to the outlet conduit comprising:

a body defining an inlet and an outlet;

a removable flow conditioner having a top surface including:

an inlet zone having an area at least twice the cross-sectional area of said inlet, there being fluid communication between the inlet conduit, said inlet, and said inlet zone;

a protrusion extending into said inlet zone;

a plurality of stationary guide vanes connected to said top surface defining a plurality of curvilinear passageways, each passageway having a beginning in fluid communication with said inlet one and each passageway having an end;

each of said passageways having a cross-sectional area at said beginning that is at least twice as large as the cross-sectional area of said end;

said body further defining a receptacle, shaped and configured to receive said removable flow conditioner, said receptacle having a bottom surface and a side wall which cooperates with said top surface of said flow conditioner to define an outlet port to contain and direct the fluid as it leaves said end of said passageways;

a transition zone defined by said body having a curved outer wall extending from said curved outer perimeter of said body, said transition zone in fluid communication with said outlet opening of said flow conditioner;

an elongate tapered discharge nozzle including:

an elongate tapered interior surface defining a discharge passageway with a generally rectangular shaped inlet and a circular outlet, said rectangular inlet in fluid communication with said transition zone and said circular outlet in fluid communication with the outlet conduit;

said discharge passageway having a length at least twice as long as the diameter of the inlet;

said discharge passageway having a generally constant cross-sectional area; and some of said passageways having a curvilinear orientation and some having a generally radial orientation from the center of the inlet zone, so that the flow path from all passageways is oriented towards the discharge nozzle and the outlet conduit.

17. A diffuser connected to a fire hydrate to reduce turbulence as fluid flows from the fire hydrant through the diffuser to a fire hose comprising:

a body defining an inlet and an outlet;

a removable flow conditioner having a top surface including:

an inlet zone having an area at least twice the cross-sectional area of said inlet, there being fluid communication between the fire hydrant, said inlet, and said inlet zone;

a protrusion extending into said inlet zone;

a plurality of guide vanes connected to said top surface defining a plurality of curvilinear passageways, each passageway having a beginning in fluid communication with said inlet zone and each passageway having an end;

each of said curvilinear passageways having a cross-sectional area at said beginning that is at least twice as large as the cross-sectional area at said end;

said body further defining a receptacle, shaped and configured to receive said removable flow conditioner, said receptacle having a bottom surface and a side wall which cooperates with said top surface of said flow conditioner to define an outlet port to contain and direct the fluid as it leaves said end of said passageways;

a transition zone defined by said body having a curved outer wall extending from said curved outer perimeter of said body, said transition zone in fluid communication with said outlet opening of said flow conditioner;

an elongate tapered discharge nozzle including:

an elongate tapered interior surface defining a discharge passageway with a generally rectangular shaped inlet and a circular outlet, said rectangular inlet in fluid communication with said transition zone and said circular outlet in fluid communication with the fire hose;

said discharge passageway having a length at least twice as long as the diameter of the inlet;

said discharge passageway having a generally constant-cross sectional area; and a yoke assembly allowing said diffuser to rotate relative to the fire hydrant.

18. The apparatus of claim 17 wherein said yoke assembly includes:

a first circumferential channel formed in the fire plug;

a second circumferential channel formed in said body;

a circumferential yoke engaging said first and said second circumferential channels; and seals to prevent fluid from leaking from said yoke assembly.

* * * * *